US009601891B2

(12) United States Patent
Yamauchi et al.

(10) Patent No.: US 9,601,891 B2
(45) Date of Patent: Mar. 21, 2017

(54) APPARATUS AND METHOD FOR ASSEMBLING CABLE

(75) Inventors: Yasuto Yamauchi, Makinohara (JP); Keisuke Matsuura, Makinohara (JP); Tomoyuki Kojima, Makinohara (JP); Yuusuke Yamamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 237 days.

(21) Appl. No.: 13/537,687

(22) Filed: Jun. 29, 2012

(65) Prior Publication Data

US 2014/0000102 A1 Jan. 2, 2014

(51) Int. Cl.

*H01R 43/055* (2006.01)
*H01R 43/24* (2006.01)
*H01R 9/05* (2006.01)

(52) U.S. Cl.

CPC ..... *H01R 43/055* (2013.01); *H01R 43/24* (2013.01); *H01R 9/05* (2013.01); *Y10T 29/53209* (2015.01)

(58) Field of Classification Search

CPC ..... H01R 43/055; H01R 43/24; H01R 43/20; H01R 9/05; Y10T 29/53209
USPC ..... 29/33 M, 747–754, 874–885
See application file for complete search history.

(56) References Cited

U.S. PATENT DOCUMENTS 3,058,091 A * 10/1962 Henschen ..... H01R 13/111 29/874
3,958,851 A * 5/1976 Evans ..... H01R 9/0518 439/295
3,990,762 A * 11/1976 Lemesle ..... H01R 4/2429 439/395
4,031,614 A * 6/1977 Gipe ..... H01R 43/16 29/879
4,214,361 A * 7/1980 Coldren ..... H01R 43/20 29/564.6
5,127,159 A * 7/1992 Kudo ..... H01R 43/20 29/564.4
5,235,743 A * 8/1993 Endo ..... H01R 13/03 29/874
5,551,150 A * 9/1996 Zielinski ..... H01R 13/187 29/882
5,709,027 A * 1/1998 Kato ..... H01R 43/01 29/33 M (Continued)

FOREIGN PATENT DOCUMENTS

JP 2009-224033 A 10/2009

*Primary Examiner* — Peter DungBa Vo
*Assistant Examiner* — Kaying Kue
(74) *Attorney, Agent, or Firm* — Locke Lord LLP

(57) ABSTRACT

A cable assembling apparatus for allowing a terminal and a electric wire to be accurately crimped and to resolve increase of facility cost incurred by separation of a press and a crimping machine, includes a press having a downside press mold having a plurality of types of dies arranged in parallel, an electric wire support jig arranged in parallel, having a metal plate guide at an end thereof entering into between the plurality of types of dies, and a feeder adapted to lift the electric wire support jig together with the metal plate above the dies of the downside press mold, and advance and descend the electric wire support jig to an adjacent die of next process. Furthermore, an electric wire chuck disposed in a midstream die of the plurality of types of dies and supplying the electric wire support jig with the electric wire is disposed.

16 Claims, 7 Drawing Sheets

(56) References Cited

U.S. PATENT DOCUMENTS

| | | | | |
|---|---|---|---|---|
| 5,737,835 | A * | 4/1998 | Murata | H01R 43/0207 29/33 M |
| 6,573,453 | B2 * | 6/2003 | Takada | B60R 16/0207 174/72 A |
| 6,808,417 | B2 * | 10/2004 | Yoshida | H01R 9/0518 439/585 |
| 7,140,914 | B2 * | 11/2006 | Kojima | H01R 4/185 439/585 |
| 7,198,509 | B2 * | 4/2007 | Takasu | H01R 24/44 439/485 |
| 7,950,959 | B2 * | 5/2011 | Chen | H01R 9/0518 439/582 |
| 8,079,870 | B2 * | 12/2011 | Nakamura | H01R 9/0518 439/585 |
| 8,104,173 | B2 * | 1/2012 | Heacox | H01R 43/16 29/825 |
| 8,414,329 | B2 * | 4/2013 | Morikawa | H01R 4/185 439/578 |
| 2005/0233653 | A1 * | 10/2005 | Yamada | H01R 13/03 439/886 |
| 2006/0172610 | A1 * | 8/2006 | Sakai | H01R 43/24 439/736 |
| 2007/0246241 | A1 * | 10/2007 | Peterson | H01R 4/185 174/74 R |
| 2008/0205085 | A1 * | 8/2008 | Hwang | H01R 4/245 362/655 |
| 2009/0249609 | A1 * | 10/2009 | Heacox | H01R 43/16 29/592.1 |
| 2011/0028034 | A1 | 2/2011 | Morikawa | |

* cited by examiner

APPARATUS AND METHOD FOR ASSEMBLING CABLE

CROSS REFERENCE TO RELATED APPLICATION

This application is on the basis of Japanese Patent Application NO. 2011-053749, the contents of which are hereby incorporated by reference.

TECHNICAL FIELD

This invention relates to an apparatus and a method for sequentially crimping a terminal which is molded from a metal plate, together with a core wire of such a coaxial cable using a press for an automobile.

BACKGROUND ART

Conventionally, there have been advocated various structures for connecting a terminal with a coaxial cable including signal line for an automobile.

For example, there is described in the PTL 1 that to a core wire of a coaxial cable an inside terminal is crimped, and outside the inside terminal isolating resin (dielectric) is formed, then outside the isolating resin an outside terminal is set so as to be crimped to a conductive braid of the coaxial cable.

The inside terminal is a tubular female terminal, from tip of which a pin-type mating male terminal is inserted. The inside terminal and the outside terminal are isolated by a middle isolating resin. The inside terminal is made to be bonded with isolating resin while coupled to a carrier of lateral coupling terminal (release of the carrier, i.e., a coupling strip, simultaneously).

CITATION LIST

Patent Literature

[PTL 1]
Japanese Patent Application Laid-Open Publication No. 2009-224,033

SUMMARY OF INVENTION

Technical Problem

Notwithstanding, a connection structure of the aforementioned conventional coaxial cable poses problems that in order to crimp the core wire of the coaxial cable while the inside terminal is released from the carrier, it is difficult to crimp with high accuracy over such crimping in a round shape, it takes cost for many facilities because such as press for terminal molding and its press mold, and crimping machine for electric wire crimp and its crimp mold are separately required, and it takes more work for molding isolating resin to the terminal.

In view of the above, an object of the present invention is to provide an apparatus and a method for assembling a cable to make it possible to crimp with high accuracy such as round-shape crimp, to resolve increase of facilities incurred by separation of, the press and its mold, or crimp machine and its crimp mold, and in addition to effectively mold isolating resin to the terminal.

Solution to Problem

In order to attain the above-mentioned object, a cable assembling apparatus according to a first aspect of the present invention comprises: a press including a downside press mold having a plurality of types of dies arranged in parallel for forming a terminal from a metal plate through a plurality of processes and for crimping an electric wire to the terminal; an electric wire support jig arranged in parallel, having a metal plate guide at an end thereof entering into between the plurality of types of dies; and a feeder adapted to lift the electric wire support jig together with the metal plate above the dies of the downside press mold, and advance and descend the electric wire support jig to an adjacent die of next process.

By virtue of the aforementioned structure, it is made possible that the metal plate of mother material for terminal is fed by one pitch of the electric wire support jig to the die of the next process, and the terminal is, after pressed, formed sequentially from the metal plate by each of dies, press-fitted to the electric wire, released from the metal plate after crimped. Lift up, feed, and descent of the electric wire support jigs allow a tip thereof to bridge the die. The tip of the electric wire support jig supports the metal plate, and the metal plate guide part usually guides the metal plate.

The cable assembling apparatus according to a second aspect, in the cable assembling apparatus of the first aspect, further comprises an electric wire chuck disposed in a midstream die of the plurality of types of dies and supplying the electric wire support jig with the electric wire.

By virtue of the above-mentioned structure, the metal plate is formed by punching into plane terminal using the first die to midstream die, as well as formed into about half-circular terminal slightly bent from the plane terminal, while to the about half-circular terminal the electric wire is supplied by the electric wire chuck, and the core wire of the electric wire is inserted from above and set. From the midstream die to the last die the core wire is pressed to the terminal so as to be formed into a tube shape.

The cable assembling apparatus according to a third aspect, in the cable assembling apparatus of the first or the second aspect, the feeder is provided with a fixed frame and a movable plate, each having positioning parts relative to the electric wire support jig, and wherein the movable plate is movable in a vertical or a horizontal direction relative to the fixed frame.

By virtue of the above-mentioned structure, the electric wire support jig is supported by the movable plate so as to ascend or proceed in a die-arranging direction, and at die position for the next process the movable plate descends below the fixed frame, then the electric wire support jig is supported by the fixed frame so as to press the metal plate as the case stands. The fixed frame is made fixed, and the movable plate at a descent position backs to its original position.

The cable assembling apparatus according to a forth aspect, in the cable assembling apparatus of any one of the first to the third aspects, the downside press mold includes a metal plate positioning part, the metal plate positioning part is disengaged from the metal plate when the metal plate is lifted, and is engaged with the metal plate when the metal plate is fed and descended.

By virtue of the above-mentioned structure, the metal plate, when being processed by the die, is accurately positioned without rattle by the positioning part of the press mold. This allows process of the metal plate, i.e., forming of the terminal and crimping of the terminal to the electric wire to be accurate.

The cable assembling apparatus according to a fifth aspect, in the cable assembling apparatus of any one of the first to the forth aspects, further comprises a resin-molding machine bonding isolating resin to the terminal crimped to the electric wire, the electric wire with the terminal is fed into the resin-molding machine while supported by the electric wire support jig.

By virtue of the above-mentioned structure, the electric wire supported by the electric wire support jig, while crimped to the terminal, is quickly fed together with the electric wire support jig to next process of resin molding machine to bond isolating resin to the terminal.

The method for assembling cable according to a sixth aspect comprising the steps of; (a) arranging each of an electric wire support jig between a plurality of types of parallel dies of a downside press mold of a press; (b) supplying a metal plate along the plurality of types of dies; (c) positioning the metal plate by a metal-plate-positioning part of the downside press mold; (d) pressing the metal plate with the die while the metal plate is guided and supported with the electric wire support jig; (e) lifting the electric wire support jig above the dies integral with the metal plate, advancing by one pitch and descending the electric wire support jig; (f) positioning the metal plate at an adjacent die of next process, and pressing the metal plate; (g) repeating the steps from (a) to (f) to form a terminal from the metal plate with the plurality of types of dies, and crimping the electric wire to the terminal.

By virtue of the above-mentioned structure, the metal plate that is the mother material of the terminal, is fed by one pitch onto each process of die by advancing the electric wire support jig, sequentially forming the terminal from the metal plate by each of the die, crimping and connecting the terminal to the electric wire, separating the terminal from the metal plate after crimping. Lifting, feeding and descending of the electric wire support jig allow the tip of the electric wire support jig to bridge the die. The tip of the electric wire support jig is made to support the metal plate, and the metal plate guide is made to usually guide the metal plate.

The method for assembling cable according to a seventh aspect, in the method of the sixth aspect further comprises the step of (h) feeding the electric wire integral with the terminal support jig to an adjacent resin-molding machine, and bonding isolating resin to the terminal.

By virtue of the above-mentioned structure, the electric wire supported by the electric wire support jig, while crimped to the terminal, is quickly fed together with the electric wire support jig to next process of resin molding machine to bond isolating resin to the terminal.

Advantageous Effects of Invention

According to the invention recited in the first aspect, sequentially pressing the metal plate by the plurality of types of dies makes it possible to accurately form the terminal into round shape (tubular shape), as well as to securely connect the terminal with the electric wire by accurate crimp such as round-shape crimp following forming into round shape. Sequentially forming the terminal on a plane of the metal plate and crimping the electric wire to the terminal on the same plane makes it possible to reduce the cost for manufacturing the electric wire with the terminal as well as save work space because of saving work for reel-winding of the terminal each time or carrying of the reel-wind of the terminal. Furthermore, employing the same apparatus for press mold for forming the terminal and for crimping mold for connecting electric wire makes it possible to prevent increase of facility cost that would be incurred by completing each of these molds, and to effectively and cost-favorably manufacture the electric wire with terminal.

According to the invention recited in the second aspect, the electric wire chuck makes it possible to readily supply the electric wire with the midstream die of the plurality of types of dies, and securely set and insert the core wire of the electric wire into the half-open terminal during manufacturing process.

According to the invention recited in the third aspect, it is made possible to smoothly move the electric wire support jig according to terminal process sequence by moving the movable plate upwardly, forwardly, downwardly, and backwardly. Furthermore, it is made possible to securely support the electric wire support jig by the fixed frame.

According to the invention recited in the forth aspect, it is made possible to accurately position the metal plate without rattle by the metal plate positioning part of the press mold, and to accurately form the terminal from the metal plate through each of dies and crimp the electric wire to the terminal.

According to the invention recited in the fifth aspect, it is made possible to accurately position the terminal by quickly feeding the electric wire crimped with terminal to resin molding machine along with the electric support jig, and to accurately mold the isolating resin to the terminal.

According to the invention recited in the sixth aspect, it is made possible to accurately form the terminal into round (tubular) shape by sequentially pressing the metal plate with the plurality of types of dies, and further to securely connect the terminal with the electric wire by accurate swage such round-shape crimp following forming round. Furthermore, it is made possible by sequentially forming the terminal on a plane of the metal plate to crimp the electric wire with the terminal on the same plane, to save work for reel-winding the terminal each time or carrying of the reel-wind of the terminal to reduce manufacturing cost for the electric wire with terminal, and save space for manufacturing as well. Furthermore, as using the same apparatus for press molding for terminal forming and for crimp mold for electric wire connection, it is made possible to prevent increase of facility cost that would be incurred by completing each of these molds, and to effectively and cost-favorably manufacture the electric wire with terminal.

According to the invention recited in the seventh aspect, it is made possible to accurately position the terminal by quickly feeding the electric wire crimped with terminal to resin molding machine along with the electric support jig, and to accurately mold the isolating resin to the terminal.

DESCRIPTION OF EMBODIMENTS

FIGS. 1 to 9 illustrate one embodiment of a cable assembling apparatus and a method for assembling cable according to the present invention.

Figure 1:
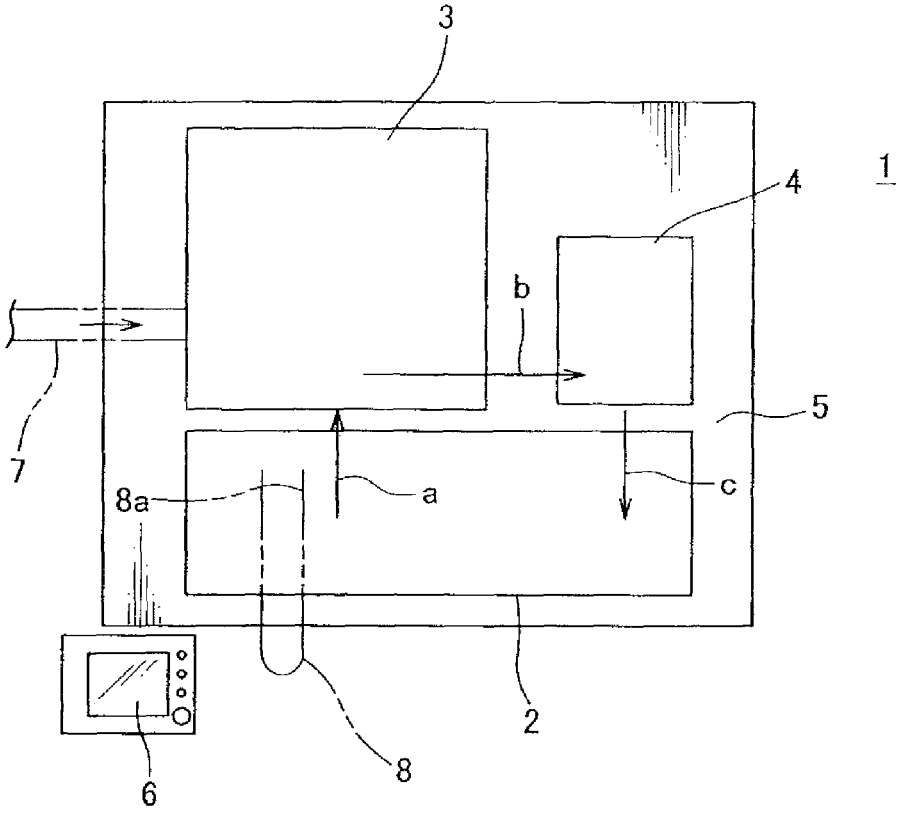
FIG. 1 is an entire layout chart illustrating one embodiment of a cable assembling apparatus according to the present invention.

As shown in FIG. 1, the cable assembling apparatus 1 is configures to arrange an electric wire feeder 2, a terminal press 2, and a resin molding machine 4 on one support stand 5, and each of the machines 2 to 4 is collectively operated on operation monitor 6. A sideway conductive metal plate 7 that is mother material of a terminal is fed from left side of the press 3. The molding machine 4 is arranged at the right side of the press 3, and the feeder 2 is arranged in front of the press 3 and the molding machine 4.

The electric wire 8 (a coaxial cable) while for example bent in U-shape, is held with such a not-shown clip, a terminal 8*a* as shown by an arrow a is fed from the feeder 2 to the press 3 with a chuck 13 (see FIG. 2), and the electric wire 8, while loaded on an electric wire clamp 9 (an electric wire support material or an electric support jig) as described later, is crimped to a terminal 10 (FIG. 3), then an electric wire with terminal 11 (FIG. 3) is fed along with the electric wire clamp 9 from the press 3 to the molding machine 4, and an isolating resin 12 (FIG. 9) is formed outside the terminal 10 (FIG. 3) by the molding machine 4, and then as shown by an arrow c is fed together with the electric wire clamp 9 from the molding machine 4 to the feeder 2 as a process-completed product.

Figure 2:
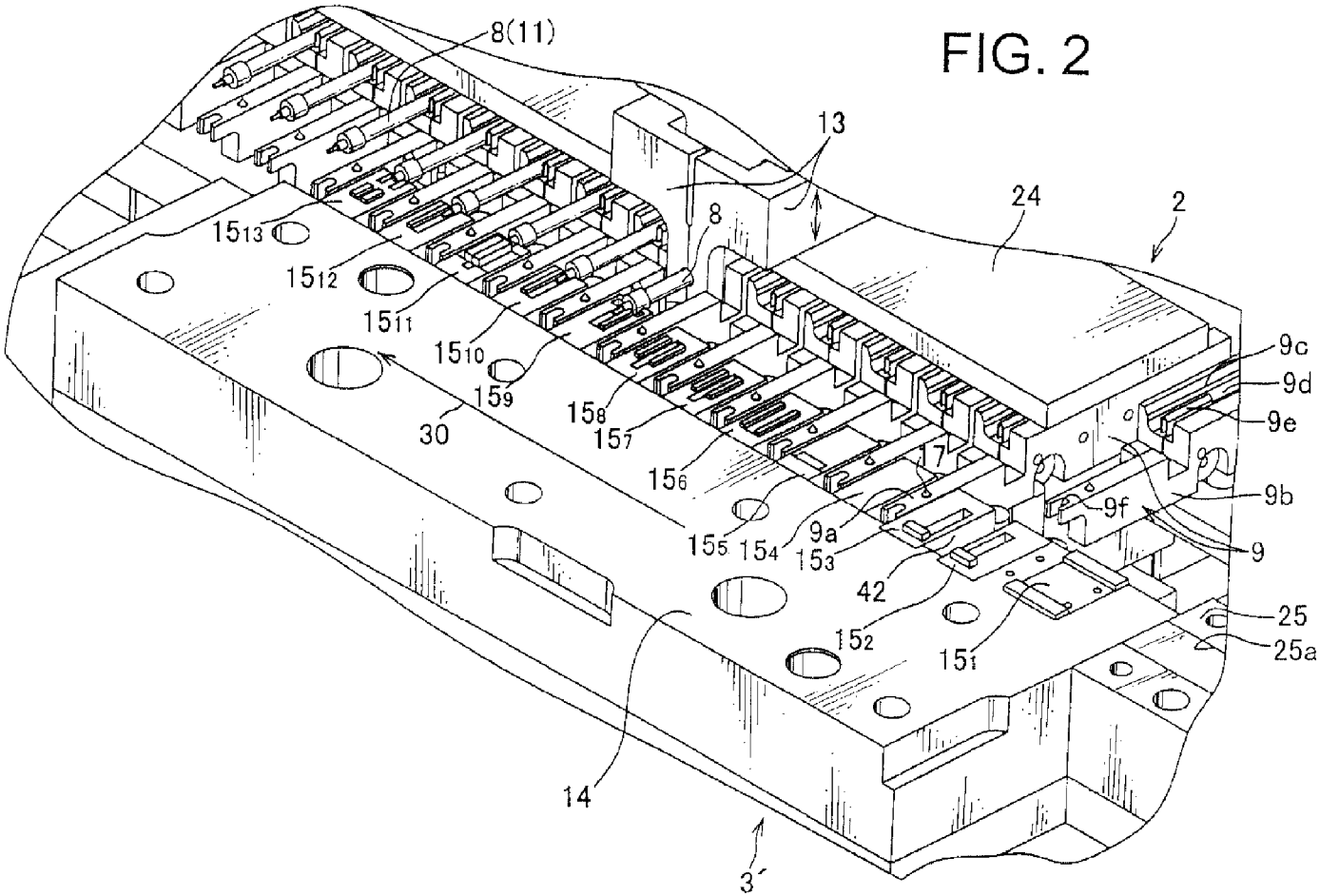
FIG. 2 is a perspective view illustrating a press and a feeder of the cable assembling apparatus and a method for cable assembling employing the same.
Figure 3:
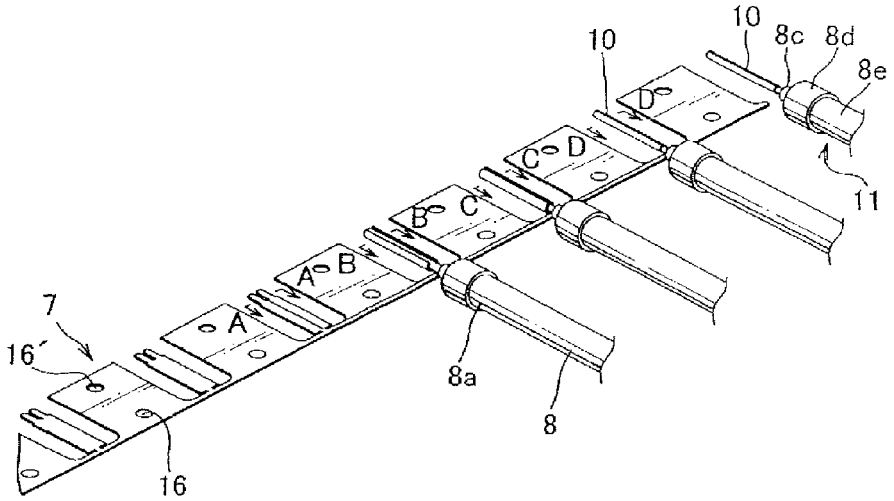
FIG. 3 is a perspective view illustrating a state of forming a terminal from a metal plate by the press and crimping the terminal with an electric wire.
Figure 4:
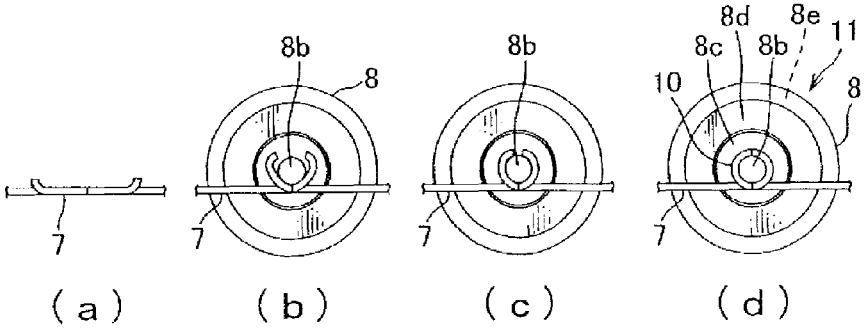
FIG. 4 is a cross-sectional view taken from each line in FIG. 3, wherein (a) is a view taken from A-A line, (b) from B-B line, (c) from C-C line, and (d) from D-D line.

The electric wire 8 in FIGS. 3, 4 is a coaxial cable, and is composed of an isolating inner layer covering a core wire 8*b*, a braid 8*d* covering the inner layer 8*c*, and an isolating outer layer 8*e* covering the braid 8*d*. The core wire 8*b* or braid 8*d* is preliminarily decorticated (exposed), and the braid 8*d* is bent over the isolating outer layer 8*e*. Note that the number of the dies 15 and its shape in FIG. 2 are optionally changed in accordance with a type of the terminal 10, not necessarily entirely corresponding to FIG. 3.

As shown in FIG. 2, a tip (rear end) 9*a* of the electric wire clamp 9 on the feeder 2 enters into front side of the press mold 14 down the press 3 (FIG. 1) (lapping from right to left) to be arranged between dies 15. Between dies $\mathbf{15}_2$ to $\mathbf{15}_{13}$ except the first die $\mathbf{15}_1$ a space 42 receiving each of the electric wire clamps 9 is formed. The electric clamp 9 is inserted into between dies $\mathbf{15}_2$ to $\mathbf{15}_3$, second and third from the right, respectively, with not-shown chuck. The reference sign 3' in FIG. 2 shows a press mold composed of a downside press mold 14 and a not-shown upside press mold.

Each electric wire clamp 9 moves by one pitch in up, down, right, and left directions by feeder 2 as discussed below, to feed the metal plate 7 (FIG. 3) and the electric wire 8 to the adjacent die 15 (next process) over the current die 15. The electric wire clamp 9 not feeding the electric wire 8 between dies from $\mathbf{15}_1$ to $\mathbf{15}_8$ feeds the metal plate 7 (FIG. 3) between dies $\mathbf{15}_9$ to $\mathbf{15}_{13}$. In FIG. 2 a feeding direction of the metal plate 7 and the electric wire 8 is shown by the reference sign 30.

At this time, disposition (lift) of each of the electric wire clamps 9 is prevented by holding with an upper metallic holder plate 24. The holder plate 24 moves above the each of the electric wire clamps 9 by a not-shown feeder apparatus such as a horizontal cylinder in a horizontal direction, and descends by a feeder apparatus such as a vertical cylinder so as to ascend or descend together with each of the electric wire clamps 9.

Between dies $\mathbf{15}_2$ to $\mathbf{15}_3$, the second and the third from the right in FIG. 2, an empty space electric wire clamp 9 (which is completed in resin molding as described later) is fed, and in die $\mathbf{15}_9$ of round molding as mentioned above the electric wire is fed with the electric wire clamp 9. In FIG. 2 the metal plate 7 and the terminal 10 are omitted, and on each die 15 the metal, plate 7 or the terminal 10 in FIG. 3 is arranged. The bar-shaped metal plate 7 is fed onto each die 15 along horizontal groove 25*a* of right end guide block 25 in FIG. 2.

Each electric wire clamp 9 is arranged in parallel at even intervals in a feeding direction of the electric wire, i.e., arranging direction of the dies 15. The electric wire clamp 9 is made of metal material, and is composed of a right half part 9*b* and left half part 9*c*, which right half part 9*b* has positioning pin (metal plate positioning part) at its top adapted to enter into, and engage with, a hole 16 in front (at base side) of the metal plate 7 (FIG. 3), which left half part 9*c* has a reversed U-shaped spring part 9*e* for fixing the electric wire at one side of a groove 9*d* for insertion of the electric wire in a front and rear direction positioned at front side of the right half.

The electric wire 8, while held by a pair of right and left electric wire chucks 13, is horizontally pushed into the groove 9*d* so as to be nipped by the spring part 9*e*. The electric wire chuck 13 is arranged movable in up, down, right and left directions by a not-shown feeder such as an X-Y direction rail, a ball screw, or a cylinder.

Figure 5:
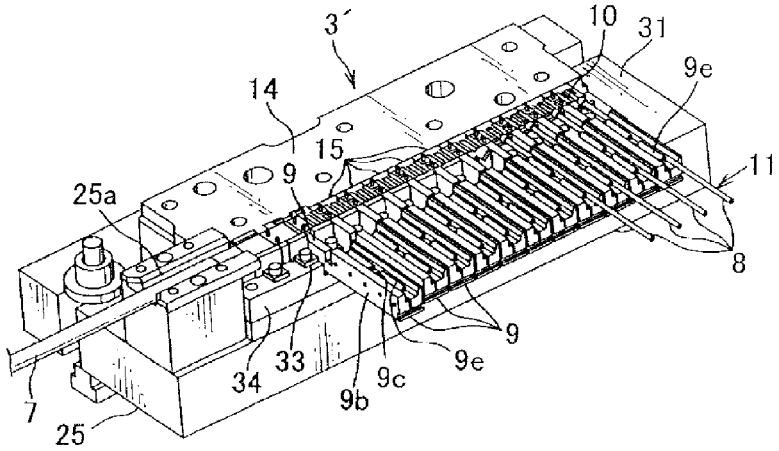
FIG. 5 is a perspective view illustrating a state of an initial position of an electric wire clamp in the press.
Figure 6:
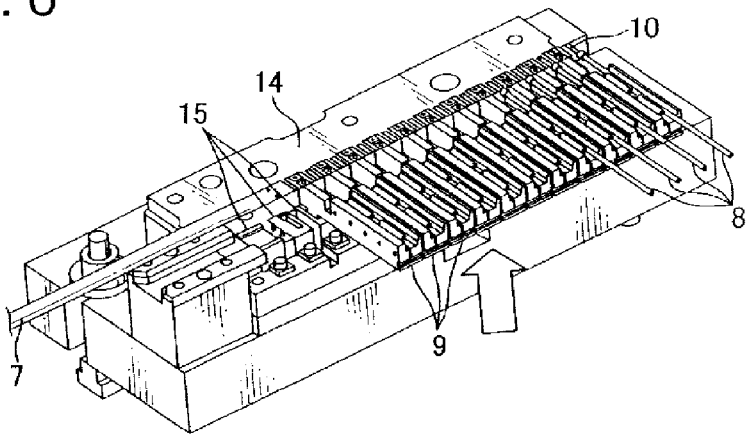
FIG. 6 is a perspective view illustrating a state of a lift-up position of an electric wire clamp in the press.
Figure 7:
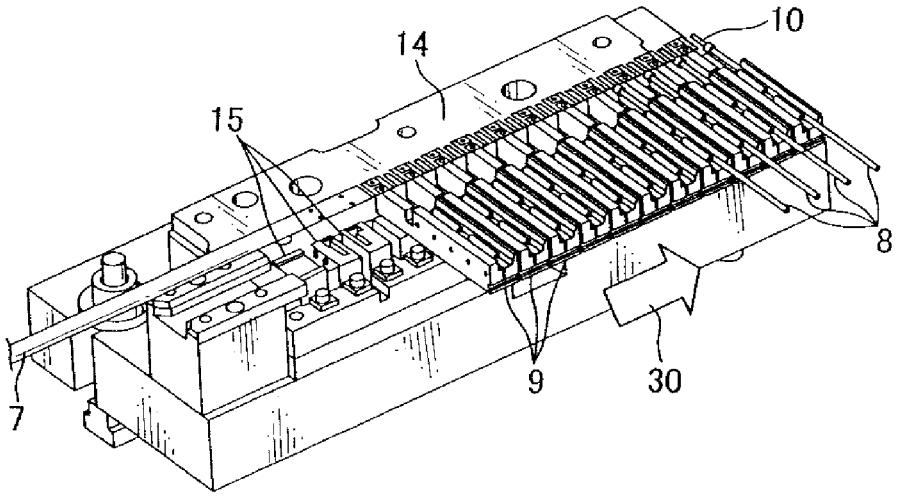
FIG. 7 is a perspective view illustrating a state of a frontward (traverse) position of an electric wire clamp in the press.

FIGS. 5 to 7 show motion of each of the electric wire clamps 9 in the press 3 in up, down, right, and left directions.

Figure 9:
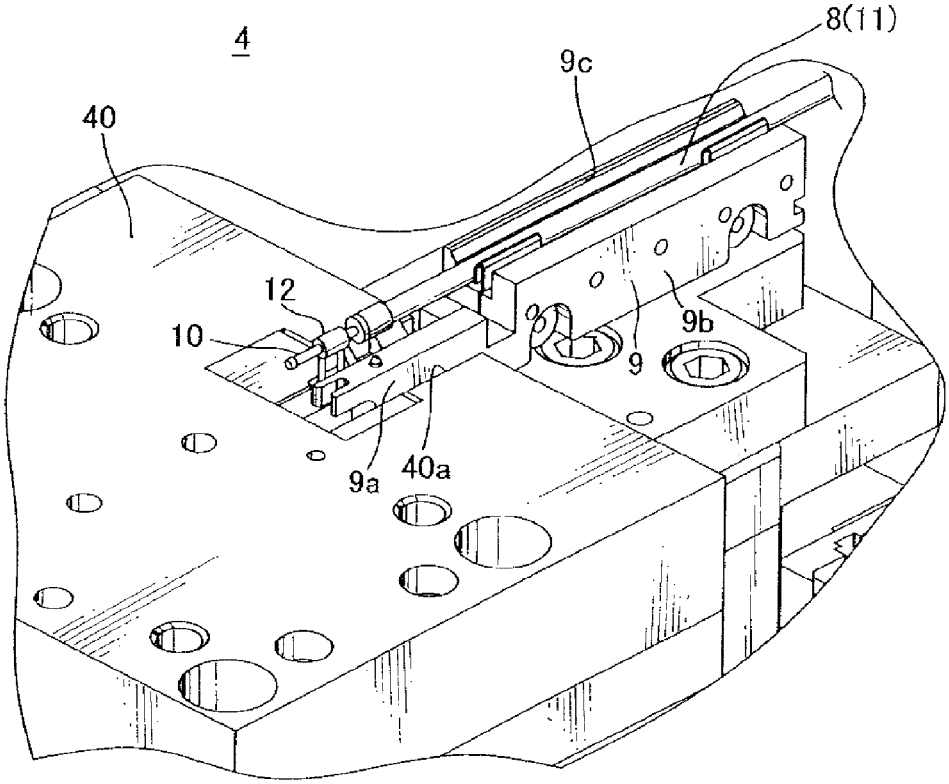
FIG. 9 is a perspective view illustrating one embodiment of resin molding machine of the cable assembling machine and a method for assembling the cable employing the same.

Each process for the metal plate 7, as shown in FIG. 5, is performed with each die 15 every each of the parallel electric wire clamps 9, and each of the electric wire clamps 9 as shown in FIG. 9 ascends together with the metal plate 7 and the electric wire 8 as indicated by the arrow to be positioned above the die 15 of the down press mold 14, then each of the electric wire clamps 9 as shown in FIG. 7 moves rightward (leftward in FIG. 2) by one pitch as indicated by the arrow 30 together with the metal plate 7 and the electric wire 8 to be positioned above adjacent each die 15, each of the electric wire clamps 9 in this state descends together with the metal plate 7 and the electric wire 8, and the metal plate 7 is pressed at one step ahead from a state of FIG. 5. In the left end guide block 25 in FIG. 5, the metal plate 7 is nipped by a not-shown chuck together with each of the electric wire clamps 9 so as to be fed by one pitch by such the parallel cylinder.

The reference sign 31 in FIG. 5 indicates a base block on which a mold 14 is mounted. At a front end of the mold 14 a projecting wall 34 arranged lower by a step is disposed, and on the projecting wall 34 a not-shown positioning part adapted to enter into, and engage with, a tip part 9*a* of the left half part 9*b* of the electric wire clamp 9.

Figure 8:
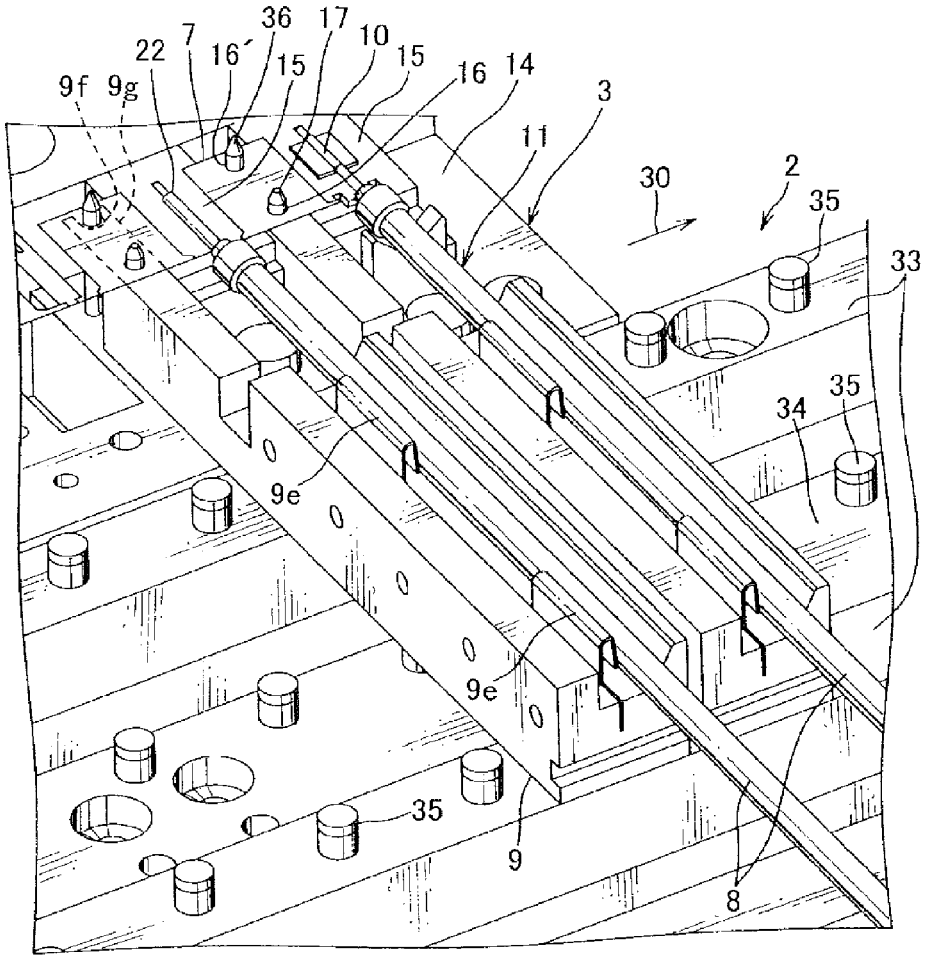
FIG. 8 is a perspective view illustrating a feeder structure of the electric clamp and a positioning structure in the feeder.

As shown in FIG. 8, the feeder 2 is provided with a front and rear fixing frames 33 and a middle movable plate 34, which the fixing plate 33 and the movable plate 34 each have positioning pins (positioning parts) 35 relative to each of the electric wire clamps 9, and which the movable plate 34 ascends or descends by for example a first driver such as a not-shown vertical cylinder, and advances or backs by one pitch in a right or left direction by a second driver such as a not-shown vertical cylinder. Each of electric wire clamps 9 is held on a top face of the movable plate 34 to move together with the movable plate 34.

Namely, the movable plate 34 ascends above the fixing frame 33 to move each of the electric wire clamps 9 by one pitch in the feeding direction (right direction or the arrow 30 direction in FIG. 8), and the movable plate 34 descends below the fixing plate 33 to make each of the electric wire clamps 9 to be held on the fixing frame 33, while the movable plate 34 only backs by one pitch in the left direction in FIG. 8 (the reverse direction of the arrow 30) to turn to an original position.

Each of positioning pins 35 for the fixing frame 33 and the movable plate 34, when each of the electric wire clamps 9 in FIG. 5 is descending (that is, the movable plate 34 is descending), enters into, and engages with, a not-shown positioning hole at a bottom side of each of the electric wire clamps 9, and when each of the electric wire clamps 9 in FIG. 5 is ascending (that is, the movable plate 34 is ascending), disengages from the positioning hole for each of the electric wire clamps 9.

As shown in FIG. 8, the lower press mold is provided with a positioning pin 36 (metal plate positioning part) adapted to enter into, and engage with, a round hole 16' on rear side of the metal plate 7 each vertically upstanding between the dies 15 at even intervals. A guide pin 17 on an upper tip of the electric wire clamp 9 enters into, and engages with, the round hole 16 (guide hole) in front of the metal plate 7, and the positioning pin 36 engages with the round hole 16' (positioning hole) in moderate close-fitting. The metal plate 7 is without waggle accurately positioned by the positioning pin 36.

The positioning pin 17 of the electric wire clamp 9 is always engaged with the positioning pin 16 of the metal plate 7, while the positioning pin 36 of the lower press mold 14, when the metal plate 7 ascends integral with the electric wire clamp 9, disengages from the positioning hole 16' of the metal plate 7, and when the metal plate 7 advances and descends integral with the electric wire clamp 9, enters into, and engage with, the adjacent positioning hole 16' of the metal plate 7. The positioning pin 36 of the lower press mold 14 vertically passes through a recessed groove 9*f* at a tip of the electric wire clamp 9 to engage with the positioning hole 16' of the metal plate 7. A right and left clamping top face 9*g* stably holds the metal plate 7 with its large area.

The electric wire 11 with the terminal in which a carrier is cut by the last die $\mathbf{15}_{13}$ in FIG. 2 is held by a not-shown chuck together with the electric wire clamp 9 to be fed to the resin molding machine 4 by a not-shown feeder.

The tip 9*a* of the electric wire clamp 9 is inserted into the front opening 40*a* of the lower resin molding mold 40 from above or front, and the terminal 10 of a tip of the electric wire 8 (electric wire 11 with the terminal) is positioned between the lower resin molding mold 40 and a not-shown upper resin molding mold, a tubular isolating resin material 12 is formed outside the terminal 10 while the upper and lower resin molding mold are closed.

The electric wire 11 with the terminal molded with the isolating resin material 12 is fed frontward by a not-shown chuck to separate the electric wire clamp 9 and the electric wire 11 with the terminal, then the electric wire clamp 9 is turned to right end (re-applied) of the feeder 2 in FIG. 2 by another not-shown chuck, and the electric wire 11 with the terminal molded with the isolating resin material is outputted as an interim product.

The electric wire with terminal 11 molded with isolating resin material 12, after each die 15 in FIG. 2 is changed, is assembled with an not-shown outer terminal outside the isolating resin 12 with each not-shown changed die, which the outer terminal is then crimped and connected with the braid 8*d* of the electric wire 8.

While the above description is mainly related to the cable assembling apparatus 1, the description by replacing its passive description to active description allows to read a method therefore. These cable assembling apparatus 1 and the method for assembling cable make it possible to form the terminal 10 by the metal plate 7 by press 3 and to crimp the terminal 10 to the electric wire 8 at the same time. Furthermore, it is made possible to improve setting position accuracy for the electric wire 8 by, e.g., correcting a tip position of the electric wire 8 using image processing when the electric wire 8 is set to the electric wire clamp 9. Moreover, it is made possible that the press 3, the resin molding machine 4, feeder 2, and the image processing are collectively operated via one operation monitor 6.

INDUSTRIAL APPLICABILITY

The cable assembling apparatus and the method for assembling cable relevant to the present invention, when for example assembling a connector for high frequency band for automobile, can be employed for accurately crimping and connecting a terminal to a core wire of a coaxial cable, or for crimping and connecting a terminal that cannot be wound to a reel to electric wire, as well as for saving plant cost by integrating a press and a crimp machine, or a pressing mold and a crimping mold.

REFERENCE SIGNS LIST

1 cable assembling apparatus
2 feeder
3 press
4 resin molding machine
7 metal plate
8 electric wire
9 electric wire clamp (electric wire support jig)
9*a* tip
10 terminal
12 isolating resin
13 electric wire chuck
14 downside press mold
15 ($\mathbf{15}_1$ to $\mathbf{15}_{13}$) die
17 guide pin (metal plate guide)
33 fixing frame
34 movable plate
35 positioning pin (positioning part)
36 positioning pin (metal plate positioning part)

The invention claimed is:

1. A cable assembling apparatus for sequentially crimping a terminal together with an electric wire of the cable, comprising:

a press including a downside press mold having a plurality of dies arranged in parallel and fixed to the downside press mold, the plurality of dies sequentially formed in different forms from each other, sequentially forming the terminal into a tubular shape from a metal plate, and crimping the terminal together with the electric wire, wherein each die processes a different stage of crimping from each other;

electric wire support jigs arranged in parallel, each having a metal plate guide pin configured to fit through a through hole provided in the metal plate for guiding the metal plate, with the terminal remaining to be cut from the metal plate, at an end thereof entering into between the plurality of dies, the electric wire support jigs being arranged on the downside press mold; and a feeder being arranged in a front side of the downside press mold and separately from the press, lifting the electric wire support jigs together with the metal plate, with the terminal remaining to be cut from the metal plate, above the plurality of dies, and advancing and descending the electric wire support jigs to an adjacent die of next process.

2. The cable assembling apparatus as claimed in claim 1, further comprising an electric wire chuck disposed in a midstream die of the plurality of dies and supplying the electric wire.

3. The cable assembling apparatus as claimed in claim 1, wherein the feeder is provided with a fixed frame and a movable plate, each having positioning parts relative to the electric wire support jig, and wherein the movable plate is movable in a vertical or a horizontal direction relative to the fixed frame.

4. The cable assembling apparatus as claimed in claim 2, wherein the feeder is provided with a fixed frame and a movable plate, each having positioning parts relative to the electric wire support jig, and wherein the movable plate is movable in a vertical or a horizontal direction relative to the fixed frame.

5. The cable assembling apparatus as claimed in claim 1, wherein the downside press mold includes a metal-plate-positioning part, and wherein the metal-plate-positioning part is disengaged from the metal plate when the metal plate is lifted, and is engaged with the metal plate when the metal plate is advanced and descended.

6. The cable assembling apparatus as claimed in claim 2, wherein the downside press mold includes a metal-plate-positioning part, and wherein the metal-plate-positioning part is disengaged from the metal plate when the metal plate is lifted, and is engaged with the metal plate when the metal plate is advanced and descended.

7. The cable assembling apparatus as claimed in claim 3, wherein the downside press mold includes a metal-plate-positioning part, and wherein the metal-plate-positioning part is disengaged from the metal plate when the metal plate is lifted, and is engaged with the metal plate when the metal plate is advanced and descended.

8. The cable assembling apparatus as claimed in claim 4, wherein the downside press mold includes a metal-plate-positioning part, and wherein the metal-plate-positioning part is disengaged from the metal plate when the metal plate is lifted, and is engaged with the metal plate when the metal plate is advanced and descended.

9. The cable assembling apparatus as claimed in claim 1, further comprising a resin-molding machine bonding isolating resin to the terminal crimped to the electric wire, the electric wire with the terminal is fed into the resin-molding machine while supported by the electric wire support jig.

10. The cable assembling apparatus as claimed in claim 2, further comprising a resin-molding machine bonding isolating resin to the terminal crimped to the electric wire, the electric wire with the terminal is fed into the resin-molding machine while supported by the electric wire support jig.

11. The cable assembling apparatus as claimed in claim 3, further comprising a resin-molding machine bonding isolating resin to the terminal crimped to the electric wire, the electric wire with the terminal is fed into the resin-molding machine while supported by the electric wire support jig.

12. The cable assembling apparatus as claimed in claim 4, further comprising a resin-molding machine bonding isolating resin to the terminal crimped to the electric wire, the electric wire with the terminal is fed into the resin-molding machine while supported by the electric wire support jig.

13. The cable assembling apparatus as claimed in claim 5, further comprising a resin-molding machine bonding isolating resin to the terminal crimped to the electric wire, the electric wire with the terminal is fed into the resin-molding machine while supported by the electric wire support jig.

14. The cable assembling apparatus as claimed in claim 6, further comprising a resin-molding machine bonding isolating resin to the terminal crimped to the electric wire, the electric wire with the terminal is fed into the resin-molding machine while supported by the electric wire support jig.

15. The cable assembling apparatus as claimed in claim 7, further comprising a resin-molding machine bonding isolating resin to the terminal crimped to the electric wire, the electric wire with the terminal is fed into the resin-molding machine while supported by the electric wire support jig.

16. The cable assembling apparatus as claimed in claim 8, further comprising a resin-molding machine bonding isolating resin to the terminal crimped to the electric wire, the electric wire with the terminal is fed into the resin-molding machine while supported by the electric wire support jigs.

* * * * *